United States Patent [19]

Montgomery et al.

[11] Patent Number: 4,887,908

[45] Date of Patent: Dec. 19, 1989

[54] MOBILE ASPHALT CRACK SEALANT APPARATUS

[76] Inventors: Darryl R. Montgomery, 3109 Amity Rd., Hilliard, Ohio 43026; David C. Raber, 10999 Converse Rd., Plain City, Ohio 43064

[21] Appl. No.: 172,295

[22] Filed: Mar. 23, 1988

[51] Int. Cl.[4] ..... B01F 15/06; B67D 5/62

[52] U.S. Cl. ..... 366/149; 366/4; 366/13; 366/24; 366/67; 222/146.2

[58] Field of Search ..... 366/2, 3, 4, 13, 22, 366/24, 64, 65, 66, 67, 149, 309, 312, 313, 144, 190, 194, 7; 165/109.1, 94; 222/146.2

[56] References Cited

U.S. PATENT DOCUMENTS

| | | | |
|---|---|---|---|
| 1,117,561 | 11/1914 | Guelich | 366/22 X |
| 2,255,986 | 9/1941 | Rapisarda | 366/312 X |
| 2,368,977 | 2/1945 | Fasold | 366/312 |
| 2,636,834 | 4/1953 | Myers | 366/3 X |
| 3,610,588 | 10/1971 | Diefenbach | 366/24 |
| 3,622,130 | 11/1971 | Malm | 366/4 |
| 3,633,664 | 1/1972 | Walsh et al. | 366/309 X |
| 3,804,380 | 4/1974 | Beutler | 366/24 |
| 3,841,527 | 10/1974 | Von Roeschlaub | 222/146.2 |
| 3,910,323 | 10/1975 | Harding et al. | 222/146.2 X |
| 4,159,877 | 7/1979 | Jacobson et al. | 366/22 |
| 4,415,267 | 11/1983 | Hill | 366/22 X |
| 4,620,645 | 11/1986 | Hale | 222/146.2 |

FOREIGN PATENT DOCUMENTS

| | | | |
|---|---|---|---|
| 3102449 | 8/1982 | Fed. Rep. of Germany | 366/22 |
| 3137508 | 4/1983 | Fed. Rep. of Germany | 366/24 |
| 1098983 | 6/1984 | U.S.S.R. | 366/4 |

*Primary Examiner*—Philip R. Coe
*Assistant Examiner*—Stephen F. Gerrity
*Attorney, Agent, or Firm*—Mueller and Smith

[57] ABSTRACT

Disclosed is a mobile sealant material apparatus comprising a frame adapted for vehicular movement and bearing a scraped-surface, indirectly-heated jacketed vessel for housing heated, fluid sealant material. Heated fluid heating media is heated in heating unit and pumped by a pump for recirculating through the jacket of the vessel in heat exchange relationship for heating sealant material housed therein and back to the media heating unit. A sealant material outlet line is attached to the vessel for withdrawing heated sealant material from the vessel. The sealant material in the outlet line also is being indirectly heated by the recirculated heating media from the media heating unit. Finally, sealant material pump is attached to the outlet line for selectively applying heated sealant material, e.g. applying crack sealant to cracks in roadways.

15 Claims, 5 Drawing Sheets

FUEL OIL HEATER
EXPANSION TANK
M
P
V
248
242
246
40
216
44
214
202
200
206
208
212
204
210
36
80
252
254
222
225
224
226
288
238
228
218
220
314
215
313
232
290
296
230
316
234
294
236
292
123
310
121
312
217
308
322
320
318
306
122
302
298
296
300
304
124
324
328
326
262
268
264
266
260
258
256
250
244
284
282
281
272
274
146
280
278
270

MOBILE ASPHALT CRACK SEALANT APPARATUS

BACKGROUND OF THE INVENTION

The present invention relates to vehicular-mounted apparatus for filling cracks in roadways and more particularly to an improved crack sealant apparatus and method for its use.

Asphalt generally is defined as the residual material obtained from the distillation of asphalt-based petroleum. Crude asphalt-based petroleums may be divided into three broad categories: asphaltic petroleums which may contain as high as 70% asphaltic bodies and generally high in solid paraffins; semi-asphaltic petroleums containing moderate amounts of asphaltic bodies which will not be generated during the distillation process; and non-asphaltic petroleums which do not carry asphaltic bodies but may generate them during distillation. Chemically, asphalts are complex aggregations of rather large aliphatic and cyclic hydrocarbon molecules. Besides the obvious hydrocarbon content, additional constituents in asphalts may include oxygen, sulfur, and nitrogen, often in substantial quantities, and iron, nickel, and vanadium present usually in trace quantities. For analytical purposes, asphalts commonly are split into two categories: asphaltenes and petrolenes. Asphaltenes are hard, friable materials insoluble in pentane. Asphaltenes are composed of hard resins and carbenes which are saturated hydrocarbons insoluble in pentane. Asphaltenes impart hardness and high softening temperature to the asphaltic compositions. Asphalts low in asphaltenes commonly are brought up to specification by catalytic oxidation and are referred to as "blown asphalts". Petrolenes are soluble in n-pentane and are composed primarily of viscous resins which can be isolated by other solvent combinations or by adsorption on surface-active clays. Petrolenes tend to impart ductility to the asphalt.

Asphaltic mixtures composed of mineral aggregate and bituminous constitutents are widely used in the road construction industry. Four major types of asphaltic mixtures are used in highway construction and maintenance: hot mixes; cut-backs; anionic emulsions; and cationic emulsions. Hot mix asphalts are used extensively in main highway construction where greater durability is required. These asphalts are characterized by a high asphaltene content making them very hard and resistant to chemical decomposition. Typical penetration values for these asphalts are in the 40 to 80 range.

Cut-back asphalts are formed by the use of an inexpensive petroleum solvent which along with the asphalt is mixed with the aggregate. The solvent evaporates leaving the asphalt binder in use. Generally, light petroleum oils or napthas are used as solvents. Of course, environmental considerations militate against the use of cut-back asphalts due to the necessary solvent expulsion from these applied asphaltic compositions.

The two final forms of asphalt include anionic emulsions and cationic emulsions. As their name implies, such emulsions are formed by the use of anionic or cationic emulsifiers for forming an oil-in-water emulsion which can be combined with aggregate for use in the road construction industry.

Aggregate used in road construction can be hydrophilic or hydrophobic depending upon the nature of the material. While the aggregate can include various mineral materials such as cinders or slags, typically the aggregate is of natural origin, such as sand, rock, or the like, typically native to the localities where the roads are being built. For example, limestone, dolemite, silica, sedimentary, metamorphic, or igneous rocks of various other kinds regularly are used in road building. Such mineral aggregates are hydrophilic in character, which characteristic generally has been considered to be primarily responsible for the existence of bitumin stripping. Stripping is defined as the breaking of the adhesive bond between the aggregate surface and the asphaltic material. When this bond is broken, the pavement is weakened and various forms of pavement distress, such as cracking or surface raveling, result.

Just as the presence of moisture inhibits a good asphalt-aggregate bond from being formed which contributes to asphalt stripping difficulties, moisture which finds its way into the interior of the roadway can contribute to pavement distress. Especially in climates subject to freezing and thawing, especially during winter months, moisture which penetrates to the interior of the pavement can be quite damaging. The volumetric expansion of water freezing causes cracks to develop which leads to premature deterioration of the roadway. Highway maintenance departments are called on to remedy premature pavement distress, yet are faced with necessary monetary and manpower constraints with respect to maintenance of such distressed roadways. Since constant capping is not economically feasible, highway maintenance departments have turned to the use of crack sealants for extending the longevity of the pavement. It is not unusual to see roadway crews effecting such cracked sealing operations in locales ranging from city streets to country roads. State and local specifications typically require the maintenance crew to utilize high pressure air to clean the crack from loose debris as well a clean the adjacent area around the crack on the roadway surface. Thereafter, a hot, asphaltic material is applied down in the crack as well as to the immediate adjacent roadway surface around the crack. Asphaltic materials utilized in crack sealing operations often are reinforced with polypropylene or another polymeric fiber. The reinforcing fiber provides a strain absorbing interlayer to prevent water penetration and provide firm adherence to the existing pavement.

Present-day apparatus for applying reinforced asphaltic crack sealants typically utilize a jacketed vessel for indirectly-heating the asphaltic crack sealant. Fuel oil or another heating media typically is disposed in the lower reservoir and is heated by propane or another fuel which can be safely transported and used. The interior of the vessel typically contains an auger mixing system for ensuring the homogeneous nature of the crack sealant, especially in view of the low density of the polypropylene or other polymeric reinforcing fiber. Unfortunately, hot spots within the oil bath typically develop along with necessary cold spots. If the asphaltic composition is heated too high (e.g. to a temperature of above about 350° F. depending upon the type of fiber used), degradation of the reinforcing fiber can occur. Thus, temperature control is of prime importance, especially considering that minimum application temperatures typically range from about 275° to 350° F. By the time that the asphaltic composition reaches application temperature and the heating of the oil bath is discontinued, convective and like forces within the oil bath continue to distribute the heat from the area immediately adjacent the heating source to the remainder of the bath. This typically results in an overheating of the asphaltic crack sealant material housed within the vessel.

BROAD STATEMENT OF THE INVENTION

The present invention is addressed to overcoming the difficulties experienced in construction and use of vehicular-mounted crack sealant apparati in particular, and to mobile heating of asphaltic and non-asphaltic sealants/coatings in general. The apparatus of the present invention comprises a frame adapted for vehicular movement. The frame additionally bears a scraped-surface, indirectly heated vessel for housing heated, fluid sealant material. The frame additionally bears heating means for heating fluid heating media and pump means for recirculating said heated media in heat exchange relationship with said vessel for heating said sealant material housed therein and back to said media heating means. The vessel is fitted with a sealant material outlet line for withdrawing heated sealant material from the vessel. This outlet line also is being indirectly heated by recirculated heating media from the media heating means. Finally, the frame bears sealant material pump means attached to said outlet line for delivering said heated sealant material, e.g. applying heated crack sealant to cracks in roadways.

Advantages of the present invention include the ability to precisely control the temperature of the sealant material housed within the heated vessel. Another advantage is the ability to utilize a smaller volume of heating media in heating the sealant material. A further advantage is a sealant material apparatus which takes advantage of the circulating heating media to jacket outlet lines for use of the apparatus in colder climates. Yet another advantage is the ability to raise the temperature of the sealant material quickly or slowly depending upon needs. These and other advantages will be readily apparent to those skilled in the art based upon the disclosure contained herein.

The drawings will be described in detail in connection with the description of the invention which follows.

DETAILED DESCRIPTION OF THE INVENTION

For proper handling and use of crack sealants, heating of the crack sealant to within the narrow temperature range is desirable. Additionally, efficient and quick heating to the desired temperature specification is of advantage. Of course, economic considerations dictate that the heating operation be conducted efficiently and by a totally portable or mobile system which can be taken to remote locations. Since the asphaltic composition will become viscous, if not solidified, at outdoor ambient temperatures (especially in fall and winter months), provision should be made so that all external lines carrying the crack sealant are protected from temperature influences which would tend to cause solidification of the crack sealant, especially when the system is idle, i.e. when the crack sealant is heated but not being delivered for application to a roadway crack. The crack sealant apparatus of the present invention exhibits these features as well as many others. For example, the apparatus can be directly mounted to the bed of a truck or similar vehicle, or can be mounted on a trailer for towing by a truck, tractor, or other vehicle.

While the invention will be described with specific reference to crack sealants it will be understood that other asphaltic materials (e.g. roof sealants, driveway sealants, or dressings, and the like) can be heated and delivered for use by the inventive apparatus. Additionally, non-asphaltic sealants (e.g. concrete sealants) also can be heated by the inventive apparatus. Thus, appropriate utilization of the inventive apparatus is limited only by sealant materials requiring heating for delivery for use. By sealant material is meant a sealant coating, filler, caulk, or like material, regardless of the term used by the art. Additionally, fillers of every description, e.g. fibers, beads, pellets, etc., may be incorporated into the sealant materials in conventional fashion.

Figure 1:
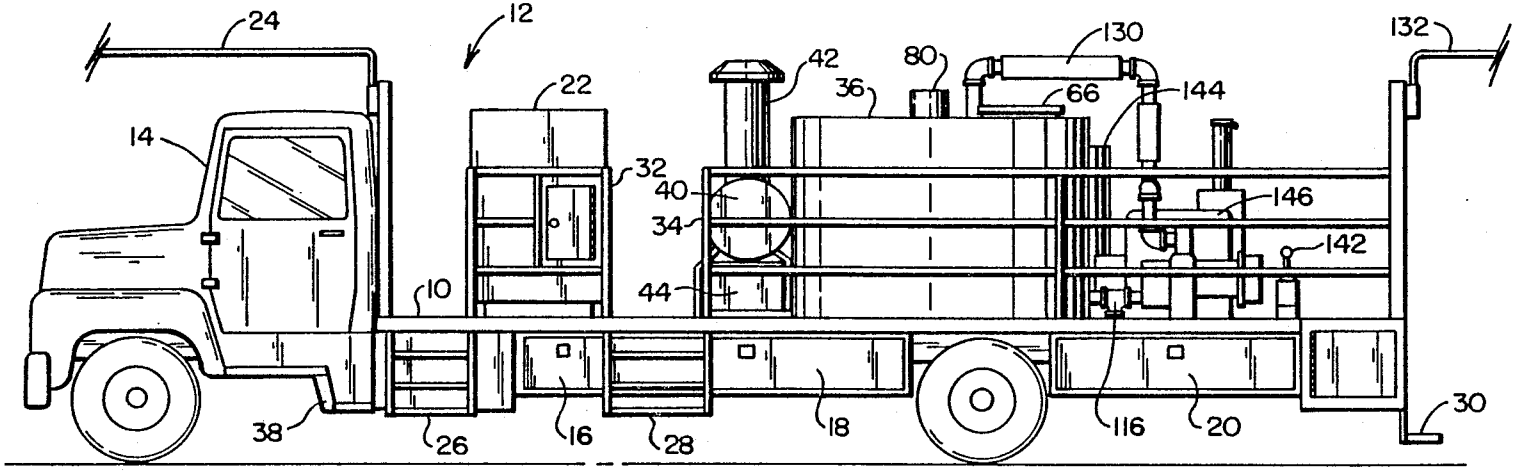
FIG. 1 is a side-elevational view of the vehicular crack sealant apparatus mounted to a frame which serves as the bed of a truck.

Referring to the embodiment of the crack sealant apparatus in the drawings, FIG. 1 depicts the crack sealant apparatus mounted on frame 10 which serves as the platform for the truck generally identified as 12. The truck is conventional with forwardly-provided cab and engine 14 and a multiplicity of toolbox or storage bins 16–20, with provision for like bins on the opposite side of the truck not shown in the drawings. In general operation, air compressor 22 supplies high pressure air via line 24 for hand operation by a worker in cleaning the interior of cracks to be sealed as well as adjacent roadway surfaces.

Access to platform or frame 10 is provided by a series of ladders 26–30 with similar ladders provided on the opposite side of the truck not depicted in the drawings. Safety railing 32 and 34 also is provided in conventional fashion with similar railing provided on the opposite side of the truck not depicted in the drawings. The foregoing features are typical of vehicularly-mounted crack sealant apparati and are retained as advantageous design features for the inventive crack sealant apparatus.

Figure 2:
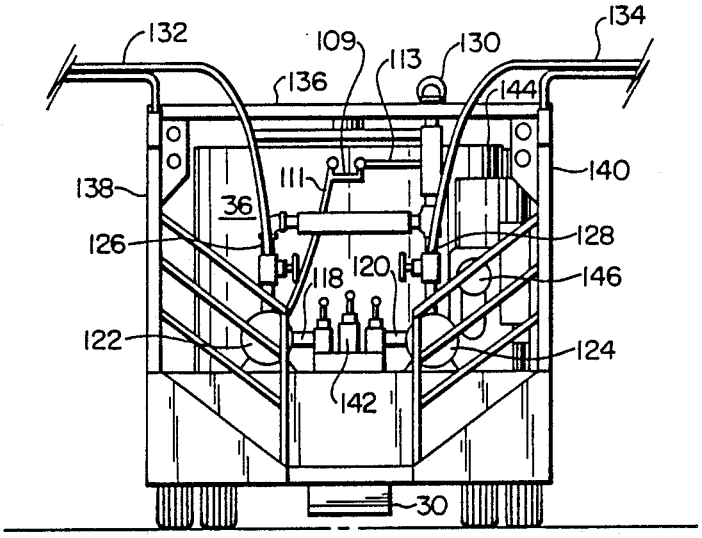
FIG. 2 is an elevational view of the rear of the vehicular crack sealant apparatus depicted at FIG. 1.

Referring in more detail to FIGS. 1 and 2, scraped-surface, indirectly-heated vessel 36 is mounted over the rear axle of truck 14 and houses the crack sealant composition. The preferred heating media comprises conventional fluid heat transfer fluids, such as Therminol 59 synthetic heat transfer fluid (Monsanto Chemical Co.) or Texatherm 46 petroleum-based heat transfer fluid (Texaco Co.) though a variety of liquid heating media can be envisioned readily for use in accordance with the precepts of the present invention. Presently, it is preferred to utilize a fuel oil-fired heater to heat the heat transfer heating media. The fuel oil is provided from tank 38 to heating unit 40 fitted with exhaust stack 42. Heating media is stored in expansion tank 44, though the bulk is contained within the heating system lines as described below. Heating vessel 40 comprises a typical shell-and-tube arrangement wherein heating media passing through the tubes is heated for transportation to the heating jacket assemblage of vessel 36. The efficiency of this design permits the precise and quick heating of the heating media within heater 40 and requires relatively little fuel oil fuel.

Figure 3:
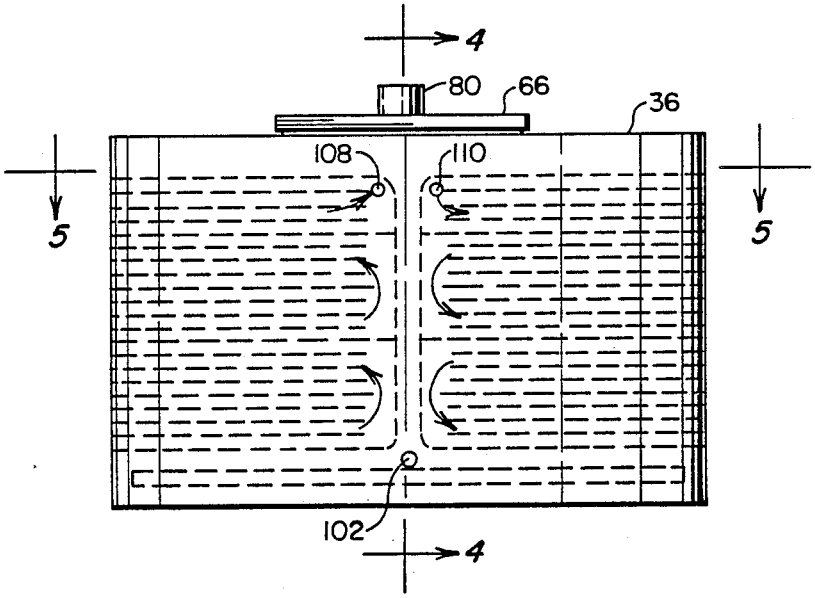
FIG. 3 is a side-elevational view of the scraped-surface, indirectly heated vessel with the heating tubes disposed within the jacket depicted in dashed lines.
Figure 4:
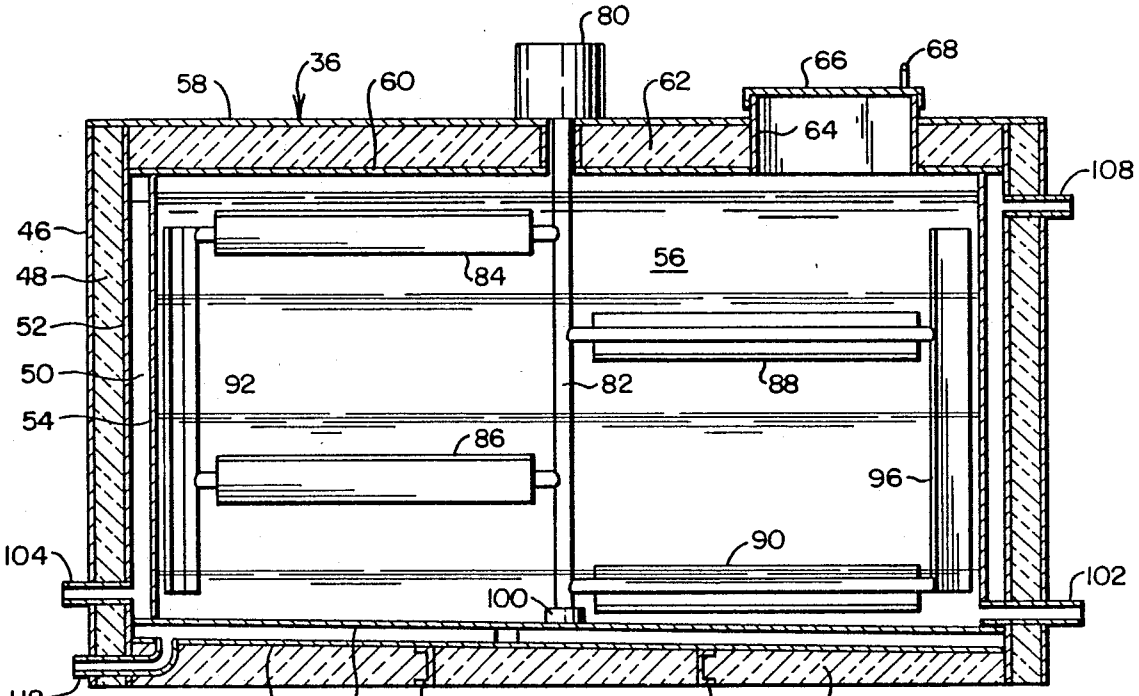
FIG. 4 is a cross-sectional elevational view taken along line 4—4 of FIG. 3.
Figure 5:
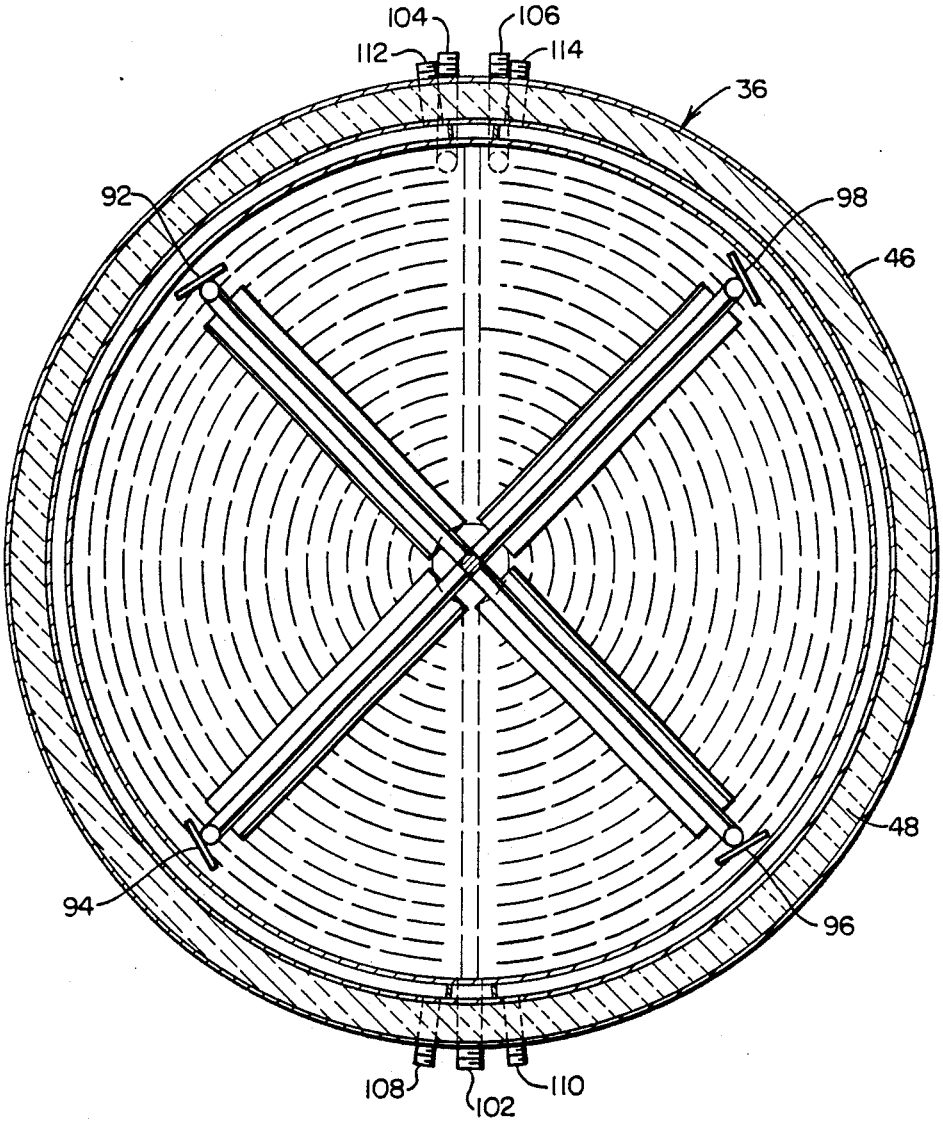
FIG. 5 is an overhead cross-sectional elevational view taken along line 5—5 of FIG. 3.

With respect to vessel 36 depicted at FIGS. 3–5, it will be observed that a double-jacketed vessel is called for. In particular, outer cylindrical surface 46 preferably is made of steel or other suitable rugged material of construction. Interior of outer shell 46 is annular insulation layer 48 which can be fiberglass or other conventional insulating material. Annular heating jacket 50 is disposed within and adjacent to insulation layer 48 with annular wall 52 providing rigidity and structural integrity to vessel 36. Finally, interior annular wall 54 directly retains asphaltic composition 56 housed within vessel 36. The top construction of vessel 36 is similar in nature having upper plate 58 and interior plate 60 retaining intermediate insulation layer 62. Housing 64 within the top of vessel 36 provides an accessway to the interior of vessel 36 for adding additional material, for example, by opening of hinged lid 66 which is provided with handle 68.

Vessel 36 has similarly-arranged lower plate 70 and interior plate or floor 72 which houses a heating jacket described with respect to FIG. 5. channel irons 74 and 76, depicted at FIG. 4, provide further structural support to the bottom of vessel 36 and are disposed within lower insulation layer 78.

Hydraulic motor 80 fitted atop vessel 36 provides rotation to fixed stirrer 82 which has a series of laterally-disposed paddle arms 84–90 (see FIGS. 4 and 5). Each laterally-disposed paddle arm bears vertically-disposed paddles 92–98 which "scrape" the interior surface of wall 54 of vessel 36. Contact with wall 54 is not necessary for the vessel to be a scraped-surface vessel. Thus, the scrapers can be tactile or atactile in design. Similarly, lower paddle 90 scrapes the interior surface of floor 72 of vessel 36. Improved heat transfer efficiencies are realized by scraping the boundary layer of crack sealant from the interior surfaces of the sidewall and floor of the vessel 36. It will be appreciated that the cant of the paddles on arms 84–90, with proper rotation of stirrer 82, fitted within bushing 100, provides a generally downward movement of the crack sealant material. This is advantageous when polypropylene or like low density fiber is incorporated into the crack sealant composition, since such material tends to float on the top of the surface. A homogeneous composition is maintained by proper rotation of fixed stirrer 82. It will be appreciated that reversal of hydraulic motor 80 results in the established flow being from bottom to top, which may be necessary should higher density fiber be incorporated into the crack sealant composition. Heated asphalt from reservoir 56 is withdrawn from the interior of vessel 36 via outlet 102 (FIG. 4).

With respect to FIGS. 3 and 5, it will be seen that the series of tubes of the shell-and-tube heating arrangement of vessel 36 is broken into two distinct flow paths within the sidewall construction of vessel 36 wherein heated heating media is passed into each side circuit via inlets 104, each side circuit being interconnected by line 109 (FIG. 2) via outlets 108 and 110. The heated heating media passes in the general flow configuration depicted at FIG. 3 from inlet 104 to outlet 108 thence in inlet 110 by line 109 to the opposite side circuit and is withdrawn via outlet 106 for recirculation into fuel oil heater 40. Similarly, heated heating media is passed into the bottom circuit on one half via inlet 112 and flows through the tube arrangement passing thence into the other half tube arrangement for final withdrawal via outlet 114 for recirculation through fuel oil heater 40.

Referring to FIGS. 1 and 2, heated crack sealant withdrawn from vessel 36 via outlet 102 passes via line 116 which is fitted with a ball valve and drain (see FIG. 6) and thence to a T-connection for passing into lines 118 and 120. The material then passes through asphalt pumps 122 and 124 which are hydraulically driven. When the system is idle, i.e. not applying material, the heated sealant then flows via lines 126 and 128, which are fitted with gate valves into return line 130 which returns the asphalt to reservoir 36. When the system is actuated, the asphaltic material is pumped via lines 132 and 134 to application wands (not shown) for use by workers in filling cracks and joints in roadways, for example. Frame members 136, 138, and 140 provide support for the asphalt lines and wand assemblies. Finally, hydraulic controls 142 are disposed between pumps 122 and 124. Hydraulic reservoir 144 can be seen adjacent tank 36 and just forward of motor 146 which preferably is diesel fuel-fired, and which provides power to the hydraulic system.

Via line 111 connected to line 109 is withdrawn heated heating media for passing through heating jackets which can be seen provided on the various asphalt lines described above. It will be appreciated that the heated heating media also passes through heating jackets 121 and 123 of pumps 122 and 124, respectively. The heating media then is returned via line 111 to inlet 110 of jacketed vessel 36 for recirculation with the remaining body of heating oil media.

Figure 6:
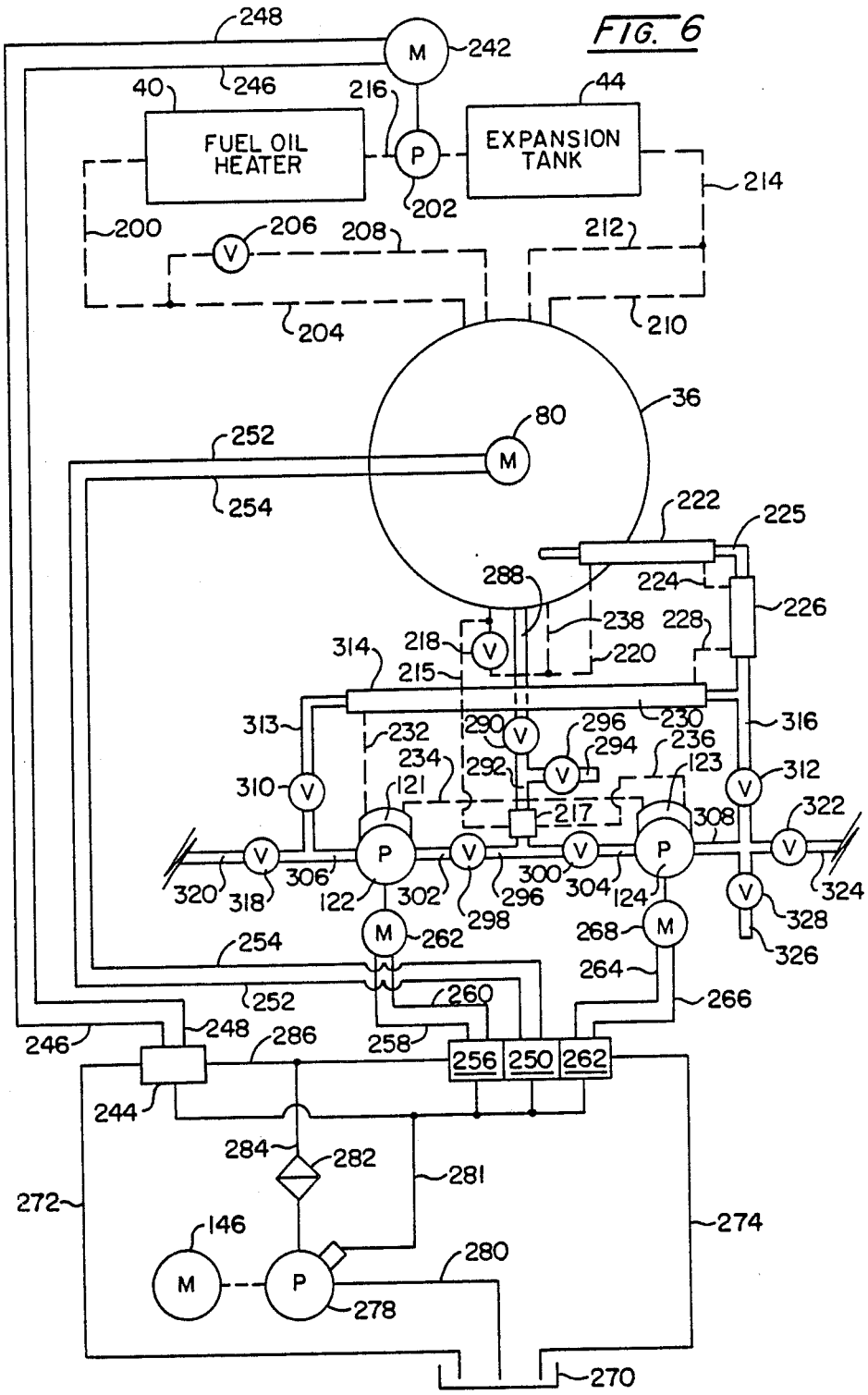
FIG. 6 is a schematic diagram showing the asphalt, hydraulic, and oil heating lines for the crack sealant apparatus depicted in the drawings.

For a fuller appreciation of the piping on the crack sealant apparatus, reference is made to FIG. 6 wherein the heating lines are shown dashed, the hydraulic lines are shown in single line and the crack sealant lines are shown in double solid lines. For ease of description, the various lines will be renumbered for explanation. Referring to the heating piping initially, heated heating media is pumped by pump 202 in line 216 through fuel oil heater 40, out line 200, and thence split into line 204 which communicates with the bottom heating circuit for vessel 36 and through valve 206 in line 208 which is in communication with one of the side heating circuits of vessel 36. Recirculation is provided from the bottom circuit via line 210 and from the other side circuit via line 212 which merge into line 214 for recirculation into expansion tank 44 which is connected via line 216 to fuel oil heater 40. Hydraulically-driven motor 242 powers pump 202.

For heating the external crack sealant lines carrying crack sealant from vessel 36, a portion of the heated heating media is bled from the initial side jacket and withdrawn via outlet 108 (FIGS. 3–5) into line 215 which transports the heating media to jacket 217 on line 292. Thence, the heating media passes via line 236 into heating jacket 123 of pump 124 and through line 234 to heating jacket 121 of pump 122. Then, the heating media is passed in line 232 into heating jacket 314 on line 313, via line 228 into heating jacket 226 on line 316, via line 224 into jacket 222 on line 225, and finally via line 220 for recombining with the bulk of the heating media in line 238 which enters vessel 36 via inlet 110.

Referring to the hydraulic piping schematic, hydraulic motor 242 is seen to drive pump 202 for the heated heating media. Hydraulic motor 242 is controlled via control unit 244 via lines 246 and 248. Hydraulic control unit 250 is connected via lines 252 and 254 to hydraulic motor 80 for rotating fixed stirrer 82. Hydraulic control unit 256 is connected via lines 258 and 260 to hydraulic motor 262 which provides power to asphalt pump 122. Hydraulic control 262 is connected via lines 264 and 266 to hydraulic motor 268 which provides power to asphalt pump 124. Hydraulic fluid reservoir 270 is seen connected via lines 272 to control unit 244 and line 274 to control units 250, 256, and 262. Hydraulic pump 278 has case drain 280 connected to reservoir 270 and is driven by motor 146. Load sensing line 281 is provided in conventional fashion. Filter 282 is contained in line 284 from pump 278 to line 286 to complete the hydraulic circuit.

Referring to the crack sealant piping, heated crack sealant from vessel 36 is withdrawn via outlet 102 which is connected to line 288 which is fitted with valve 290. Line 292 from valve 290 has drain 294 controlled by valve 296 for draining crack sealant from the system, if necessary, desirable, or convenient. Crack sealant in line 292 flows into T 296 which is in communication with valves 298 and 300 which are connected, respectively, via lines 302 and 304 to pumps 122 and 124. Crack sealant flows out of pumps 122 and 124 via lines 306 and 308, respectively. For recirculation of heated crack sealant, lines 313 and 316 contain, respectively, valves 310 and 312. Sealant material in line 313 with jacket 314 combines with sealant material exiting valve 312 in line 316, thence through line 225 heated by jackets 222 and 226 for recirculation of heated crack sealant to vessel 36, when the system is not applying the sealant material. When the system is actuated, heated crack sealant in line 306 passes through valve 318 and out line 320 to a wand, not shown, for application of the heated crack sealant. Similarly, heated crack sealant in line 308 passes through valve 322 and thence out line 324 so that two independent crack sealant deliverly systems can be used simultaneously. Finally, off of line 308 is line 326 fitted with valve 328 which serves as a pump transfer outlet for the sealant flow.

It will be appreciated that each valve has pressure compensated flow control, and is a load sensing valve. Further, the system has an adjustable pressure relief valve and other conventional fittings as is necessary, desirable, or convenient in conventional fashion. Additional instrumentation, controls, fittings, other pumps, and valves, are to be provided where necessary or desirable in conventional fashion. Materials of construction are conventional. Thus, corrosion-resistant materials such as austentic stainless steel, plastic, glass-lined steel, or even clay-lining can be used where necessary. Steel can be used where corrosion or erosion is inconsequential. Further, various of the tanks and lines illustrated can be in multiple, series, cascade, or parallel connected, for additional treating time or capacity.

We claimed:

1. A mobile sealant apparatus comprising a frame adapted for vehicular movement and bearing:

(a) a jacketed vessel for housing heated, fluid sealant material, said vessel having a jacket bearing tubes in the sidewall and bottom thereof for indirectly heating the jacketed vessel;

(b) in-line heating means for heating fluid heating media;

(c) a first line connecting said heating means to the jacket tubes of said jacketed vessel, and a second line connecting said jacket tubes to said heating means;

(d) pump means for passing said heating media from said heating means to said jacket tubes via said first line for circulating heating media through said jacket tubes in heat-exchange relationship with said vessel for heating said sealant material housed therein, and for recirculating said heating media back to said heating means from said jacket tubes via said second line;

(e) a sealant outlet line attached to said vessel for withdrawing heated sealant material from said vessel;

(f) a thrid line connecting said jacket tubes and said sealant outlet line, and thence back to said jacket tubes for indirectly heating said sealant outlet line by heating media recirculating in said third line by said pump means; and (g) sealant material pump means attached to said outlet line for transporting heated sealant material for its use.

2. The apparatus of claim 1 wherein said vessel bears a fixed, vertically mounted stirrer therein with laterally projecting scrapers.

3. The apparatus of claim 2 wherein said fixed stirrer is connected to a hydraulic motor for rotation thereof.

4. The apparatus of claim 1 wherein a layer of insulation is disposed on the outer side of said heating jacket of said vessel.

5. The apparatus of claim 1 which is mounted on a wheeled trailer.

6. The apparatus of claim 1 which is mounted on the bed of a motorized vehicle.

7. The apparatus of claim 1 wherein said heating means comprises a fuel oil-fired heater.

8. A method for heating sealant material in a mobile sealant apparatus including a jacketed vessel with tubes in the sidewall and bottom thereof, said method comprises:

(a) circulating heated fluid heating media from in-line heating means via pump means through the jacket tubes to heat fluid sealant material within the vessel, and then back to said heating means;

(b) withdrawing heated sealant from said vessel through a sealant material outlet line attached thereto, said outlet line also being indirectly heated by said circulating heating media from said media heating means; and (c) pumping said sealant material in said outlet line via sealant material pump means for delivering heated sealant material for use.

9. The method of claim 8 wherein heated sealant material in said vessel is stirred by a fixed, vertically-mounted stirrer therein which has laterally projecting scrapers.

10. The method of claim 9 wherein said fixed stirrer is rotated by a hydraulic motor.

11. The method of claim 8 wherein said jacketed vessel is provided with a layer of insulation on the outer side of said heating jacket thereof.

12. The method of claim 8 wherein said sealant material comprises crack sealant which is applied to cracks in roadways.

13. The method of claim 8 wherein said apparatus is mounted on a wheeled trailer for transport.

14. The method of claim 8 wherein said apparatus is mounted on the bed of a motorized vehicle for transport.

15. The method of claim 8 wherein said heating media is heated by said heating means which comprises a fuel oil-fired heater.

* * * * *